US012767290B2

(12) United States Patent
Li et al.

(10) Patent No.: US 12,767,290 B2
(45) Date of Patent: Oct. 20, 2026

(54) MULTI-PURPOSE RESCUE ROD FOR TOXIC GAS POISONING OR DROWNING AND ELECTRIC SHOCK RESCUE

(71) Applicant: Bo Li, Chengdu (CN)

(72) Inventors: Bo Li, Chengdu (CN); Hongquan Li, Chengdu (CN); Min Huang, Chengdu (CN); Mingjun Cheng, Chengdu (CN); Xiaorong Liao, Chengdu (CN); Chuntao Yang, Chengdu (CN); Wendan Wu, Chengdu (CN); Weiqi Tang, Chengdu (CN); Jing Rong, Chengdu (CN); Peipei He, Chengdu (CN); Mingjiu Yao, Chengdu (CN); Tingyong Yang, Chengdu (CN); Lin Yan, Chengdu (CN)

(73) Assignee: Bo Li, Chengdu (CN)

( * ) Notice: Subject to any disclaimer, the term of this patent is extended or adjusted under 35 U.S.C. 154(b) by 306 days.

(21) Appl. No.: 18/694,791

(22) PCT Filed: Dec. 28, 2022

(86) PCT No.: PCT/CN2022/142573
§ 371 (c)(1),
(2) Date: Mar. 22, 2024

(87) PCT Pub. No.: WO2023/216616
PCT Pub. Date: Nov. 16, 2023

(65) Prior Publication Data

US 2024/0391572 A1 Nov. 28, 2024

(30) Foreign Application Priority Data

May 12, 2022 (CN) ..... 202210516082.X

(51) Int. Cl.
*B63C 9/00* (2006.01)

(52) U.S. Cl.
CPC ..... *B63C 9/00* (2013.01)

(58) Field of Classification Search
CPC ..... B63C 9/00; B63C 11/00; B63C 11/12; B63C 11/22

(Continued)

(56) References Cited

U.S. PATENT DOCUMENTS

2018/0222558 A1 8/2018 Zhang

FOREIGN PATENT DOCUMENTS

CN 109693763 A 4/2019
CN 210302108 U 4/2020

(Continued)

OTHER PUBLICATIONS

State Intellectual Property Rights Bureau, Notice of the First Review Opinion issued in International Application No. 202210516082.X, Apr. 18, 2023, 14 pp.

(Continued)

*Primary Examiner* — Lars A Olson
(74) *Attorney, Agent, or Firm* — Fitch, Even, Tabin & Flannery LLP

(57) ABSTRACT

A multi-purpose rescue rod for toxic gas poisoning or drowning and electric shock rescue is provided, which includes an upright column, a C-shaped hook, and a base. The upright column, the C-shaped hook, and the base are all made of insulating materials. The upright column includes an outer cylinder and an inner cylinder. A limiting device for limiting a relative position between the outer cylinder and the inner cylinder is arranged on the outer cylinder. A lighting device is arranged at an upper end of the inner cylinder. The rescue rod is used as a clothes hanger when not used for rescue.

9 Claims, 2 Drawing Sheets

(58) Field of Classification Search
USPC ..... 441/80
See application file for complete search history.

(56) References Cited

FOREIGN PATENT DOCUMENTS

| | | | |
|---|---|---|---|
| CN | 211308922 | U | 8/2020 |
| CN | 212927138 | U | 4/2021 |
| CN | 213077280 | U | 4/2021 |
| CN | 114949717 | A | 8/2022 |
| DE | 102014002516 | A1 | 8/2015 |

OTHER PUBLICATIONS

Patent Cooperation Treaty, International Search Report issued in International Application No. PCT/CN2022/142573, Mar. 3, 2023, 6 pp.

MULTI-PURPOSE RESCUE ROD FOR TOXIC GAS POISONING OR DROWNING AND ELECTRIC SHOCK RESCUE

CROSS-REFERENCE TO RELATED APPLICATIONS

This application is a U.S. national stage application filed under 35 U.S.C. § 371 of International Patent Application No. PCT/CN2022/142573, filed on Dec. 28, 2022, which claims priority to Chinese Patent Application No. 202210516082.X, filed on May 12, 2022, both of which are incorporated herein by reference in their entireties.

TECHNICAL FIELD

The present disclosure relates to the field of life-saving equipment, and in particular, to a multi-purpose rescue rod for toxic gas poisoning or drowning and electric shock rescue.

BACKGROUND

Biogas digesters can provide low-cost and high-quality biogas fuel for rural areas, and biogas slurry and biogas residue can also be used as pesticides, fertilizers, feed, and the like, which greatly reduces the harm caused by fertilizers and pesticides, and is conducive to production of green products and pollution-free products. Moreover, after beautifying rural environment, it is not easy to breed mosquitoes, odor is reduced, and it also plays an important role in eliminating infectious diseases such as schistosomiasis and hookworm disease. Therefore, in rural areas, many peasants have built biogas digesters at their homes. Although biogas digesters have brought great convenience to rural construction, there are still certain potential safety hazards during the use of the biogas digesters. Due to the lack of safety knowledge, weak safety awareness, improper operation or the occurrence of accidents, accidents often occur where the peasants and children accidentally fall into the biogas digesters. During the process of rescuing the peasants and children who fell into the biogas digesters, due to the lack of professional rescue tools, rescue workers directly went down to the biogas digesters for rescue when they saw the emergency situation, which also results in poisoning and even multiple deaths. Furthermore, it takes a long time for the peasants to temporarily look for rescue tools such as ropes and hooks, which results in personnel deaths because of untimely rescue. In addition, although there are many wooden sticks that are easy to find in rural areas, the wooden sticks can only be used for poking and stirring, or allowing persons in the biogas digesters hold onto the wooden sticks to rescue upwards. Persons in the biogas digesters are unable to hold onto the wooden sticks to save themselves because they have lost their strength or even become unconscious after being poisoned. Meanwhile, when swimming in rural areas and drowning or accidentally falling into ponds or rivers, due to the lack of professional rescue tools, it is impossible to rescue timely, and even multiple drowning deaths will occur if other personnel went down to help rescue. In addition, when children and other personnel accidentally fall into a narrow well or a concrete pipe, it is difficult for rescue workers to go down for rescue due to narrow space. In some places, a method of enlarging a wellhead and drilling a hole next to the concrete pipe is adopted for rescue, which is time-consuming and labor-intensive, greatly delays the rescue time, and affects the rescue effect. Besides, electricity is widely used at present. However, in the process of using electricity, the occurrence of electric shock accidents is mostly because people directly come into contact with a charged body or equipment that leaks electricity due to insulation damage. Due to the lack of professional insulating rescue tools, it is impossible to rescue timely, and multiple deaths caused by electric shock will occur even other personnel go to pull or tow to help rescue.

SUMMARY

A technical problem to be solved by the present disclosure is to provide a safe and reliable multi-purpose rescue rod for toxic gas poisoning or drowning and electric shock rescue.

To solve the technical problem, a technical solution proposed in the present disclosure is as follows:

A multi-purpose rescue rod for toxic gas poisoning or drowning and electric shock rescue includes: an upright column, a C-shaped hook, a base, a fixing sleeve, and a storage battery, a limiting device, and a lighting device. The upright column, the C-shaped hook, and the base are all made of insulating materials. The upright column is arranged vertically. The fixing sleeve is arranged in a center of the base. A lower end of the upright column is inserted into the fixing sleeve. A lower end of the C-shaped hook is fixed to an upper end of the upright column. The upright column includes an outer cylinder and an inner cylinder. The storage battery is arranged in the outer cylinder. The storage battery is positioned at a lower end of an inner cavity of the outer cylinder. The storage battery is connected with a charging line. A lower end of the inner cylinder is inserted into the outer cylinder and is positioned above the storage battery. An inner diameter of the outer cylinder matches an outer diameter of the inner cylinder. The limiting device for limiting a relative position between the outer cylinder and the inner cylinder is arranged on the outer cylinder. The lighting device is arranged at an upper end of the inner cylinder. The lighting device is connected with the storage battery through a telescopic spring wire. The telescopic spring wire is positioned inside the inner cylinder.

Further, the limiting device includes a row of limiting holes and a limiting rod. The row of limiting holes formed in a side wall of the inner cylinder in a length direction of the inner cylinder, and a through hole formed in an upper end of an outer side wall surface of the outer cylinder. A central axis of the through hole is perpendicular to a central axis of the outer cylinder. The limiting rod arranged in the through hole. A diameter of the through hole is equal to that of the limiting hole. When the through hole is corresponding to one of the limiting holes, an inner end of the limiting rod extends into the limiting hole through the through hole.

Further, a circular stopper is arranged at an upper end of the limiting rod; and a central axis of the circular stopper coincides with a central axis of the limiting rod, and a diameter of the circular stopper is greater than that of the limiting rod.

Further, an annular plate is arranged at the upper end of the outer side wall surface of the outer cylinder. A central axis of the annular plate coincides with the central axis of the through hole. An inner diameter of the annular plate is greater than the diameter of the through hole. An annular groove is formed between an inner side surface of the annular plate and an outer surface of the limiting rod. A plurality of springs are arranged in the annular groove. An end of each spring is fixed to a bottom of the annular groove, and another end of each spring is fixed to an inner surface of the circular stopper. When the inner surface of the circular stopper is in contact with an outer end face of the annular plate, each spring is in a stretched state.

Further, a gas sensor, a temperature and humidity sensor, a display, an alarm, a timer, a distress caller, distress calling switch control button, and a storage battery switch are arranged on the outer side wall surface of the outer cylinder in sequence from top to bottom. A controller is integrated in the display. The gas sensor, the temperature and humidity sensor, the display, the alarm, the timer, the distress caller, and the controller are electrically connected with the storage battery, respectively. The gas sensor, the temperature and humidity sensor, the display, the alarm, and the timer are in communication with the controller through signals, respectively. The distress calling switch control button is arranged between the distress caller and the storage battery. The storage battery switch is connected to the storage battery.

Further, a plurality of hanging rings are fixedly arranged on an inner side surface of an upper end of the C-shaped hook in a length direction of the C-shaped hook. A plurality of protrusions are fixedly arranged on an outer side surface of the upper end of the C-shaped hook in the length direction of the C-shaped hook. A V-shaped groove is formed between two adjacent protrusions.

Further, the multi-purpose rescue rod for toxic gas poisoning or drowning and electric shock rescue further includes a portable oxygen cylinder, an oxygen nozzle, a Velcro male buckle and a Velcro female buckle. An outlet of the portable oxygen cylinder is connected with the oxygen pipe. The oxygen nozzle is arranged at an end of the oxygen pipe. The Velcro male buckle is arranged on the oxygen pipe. A length of the oxygen pipe between the Velcro male buckle and the oxygen nozzle is 30 cm to 50 cm. The Velcro female buckle is arranged at an upper end of an outer side wall of the inner cylinder.

Further, the lower end of the C-shaped hook is fixed to the upper end of the upright column through a rotatable structure. The rotatable structure includes a first baffle, a second baffle, a first rotating shaft and a first insertion rod. The first baffle and the second baffle fixedly arranged at a top end of the inner cylinder. The first baffle and the second baffle are arranged vertically and parallel to each other. The first rotating shaft is arranged between the first baffle and the second baffle. Both ends of the first rotating shaft are fixed to an inner side surface of the first baffle and an inner side surface of the second baffle, respectively. The lower end of the C-shaped hook is sleeved on the first rotating shaft. A first insertion hole is formed in both the first baffle and the second baffle. A second insertion hole is formed in the lower end of the C-shaped hook. A central axis of the first insertion hole formed in the first baffle coincides with a central axis of the first insertion hole formed in the second baffle. A central axis of the second insertion hole is parallel to a central axis of the first rotating shaft. The first insertion rod is arranged in the first insertion hole. A diameter of the first insertion hole, a diameter of the second insertion hole, and an outer diameter of the first insertion rod are all equal in size. When the central axis of the first insertion hole coincides with the central axis of the second insertion hole, a front end of the first insertion rod passes through the first insertion hole formed in the first baffle, the second insertion hole in the lower end of the C-shaped hook, and the first insertion hole formed in the second baffle in sequence.

Further, a rear end of the first insertion rod is fixedly connected with an anti-loss chain; and another end of the anti-loss chain is fixed to an upper end of an outer side wall of the inner cylinder.

Further, an auxiliary support device is arranged on the base. The auxiliary support device includes a plurality of third insertion holes formed in a side surface of the base and second insertion rods. The plurality of third insertion holes are uniformly distributed around the center of the base. The second insertion rods are arranged in the third insertion holes. The second insertion rods are perpendicular to the upright column and extension lines of central axes of the second insertion rods pass through the center of the base.

The present disclosure has the beneficial effects that: a usage process of the multi-purpose rescue rod for toxic gas poisoning or drowning and electric shock rescue is as follows. Once it is found that a person accidentally fell into a biogas digester, drowned, or got an electric shock, rescue workers can quickly pull out the upright column from the sleeve of the base and take the rescue rod to the side of the biogas digester, the waterfront, or the person who got an electric shock. Rescue workers extends the C-shaped hook into the biogas digester or towards the person who fell into the water or got an electric shock to hook the person up; or the person who fell into the biogas digester, drowned, or got an electric shock may actively hook the C-shaped hook onto a belt around the waist. Thus, the rescue workers may hook or poke the person in distress who fell into the biogas digester, drowned or got the electric shock out of the dangerous area. Both the upright column and the C-shaped hook are made of insulating materials, so that the occurrence of electric shock of rescue workers is avoided, which is safe and reliable. Furthermore, the length of the upright column can be freely adjusted according to a depth of the biogas digester and a distance between the person who drowned or got an electric shock and the safe area, thereby preventing search and rescue workers from entering the dangerous area and causing accidents. Moreover, the entire search and rescue process can be carried out quickly, which greatly shortens search and rescue time, and prevents the person in distress from inhaling excessive biogas or water for a long time or getting an electric shock for a long time to lead to a death caused by poisoning, drowning, or getting an electric shock. When the search and rescue process is finished, just insert the upright column back into the sleeve on the base. Moreover, the multi-purpose rescue rod may be used as a clothes hanger. Thus, the multi-purpose rescue rod may be used as a clothes hanger when not used for rescue. Once, rescue is needed, rescue workers do not need to look for rescue tools everywhere, they just remove the clothes from the multi-purpose rescue rod and take the rescue rod to the biogas digester, the waterfront, or the person who got an electric shock, which saves a lot of time for rescue workers, and the person in distress can be rescued timely. In addition, a lighting device is provided, which can adapt to night rescue and a condition with insufficient light. When rescue is performed at night or during the day with insufficient light, just turn on the lighting device, and search and rescue workers do not need to carry the lighting device, so that the rescue rod is convenient and efficient to use. When the air in the biogas digester or rescue space is thin and oxygen is insufficient, the portable oxygen cylinder may be connected to supply oxygen to the person in distress. In addition, when it is difficult to carry out rescue by a single person, the distress calling switch control button may be turned on to call out people nearby to assist in carrying out rescue.

Figure 1:
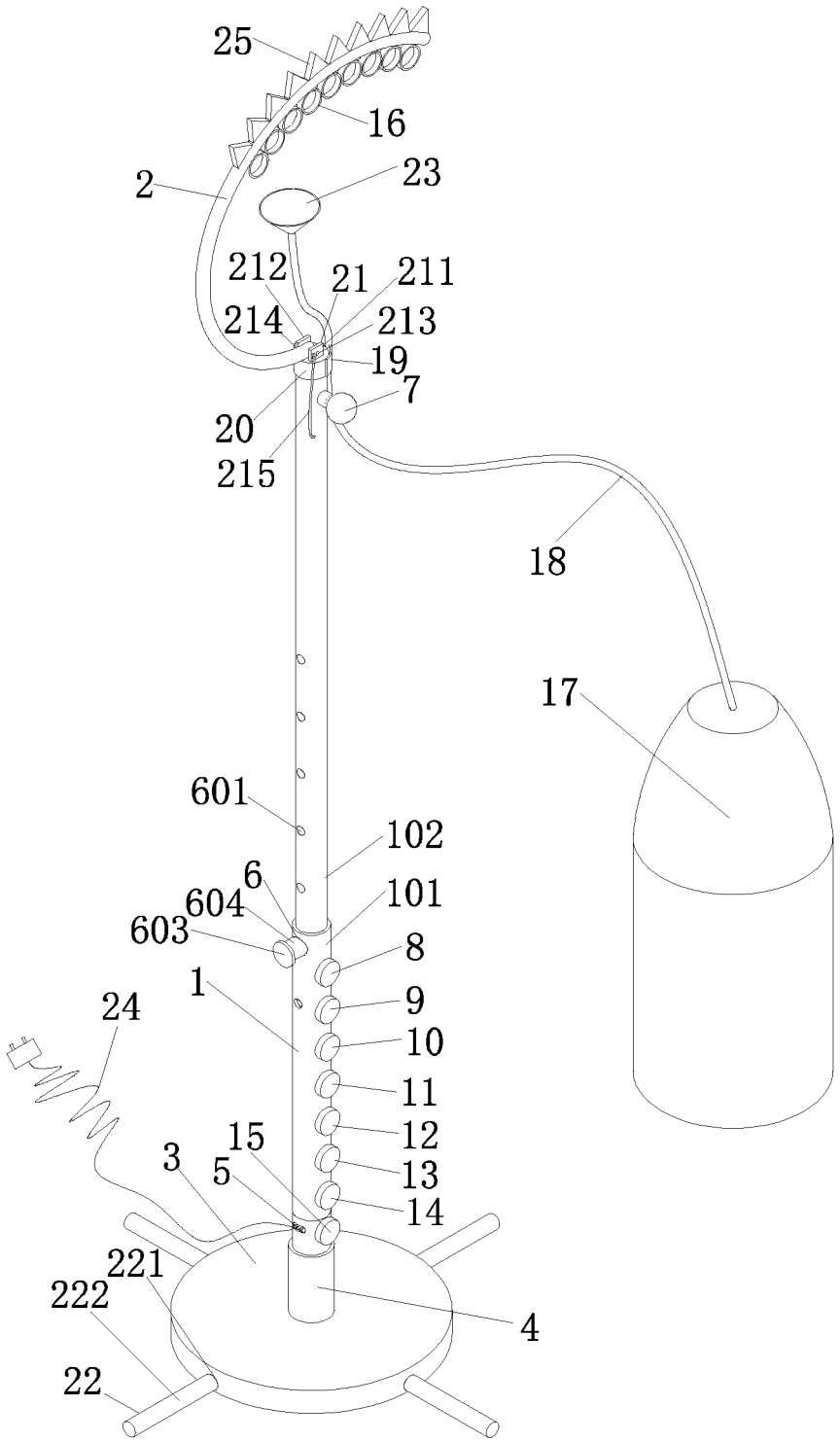
FIG. 1 is a schematic structural diagram of a multi-purpose rescue rod for toxic gas poisoning or drowning and electric shock rescue according to the present disclosure.

Reference signs in the drawings: upright column 1, outer cylinder 101, inner cylinder 102, C-shaped hook 2, base 3, fixing sleeve 4, storage battery 5, limiting device 6, limiting hole 601, limiting rod 602, circular stopper 603, annular plate 604, annular groove 605, spring 606, lighting device 7, gas sensor 8, temperature and humidity sensor 9, display 10, alarm 11, timer 12, distress caller 13, distress calling switch control button 14, storage battery switch 15, hanging ring 16, portable oxygen cylinder 17, oxygen pipe 18, Velcro male buckle 19, Velcro female buckle 20, portable structure 21, first baffle 211, second baffle 212, first rotating shaft 213, first insertion rod 214, anti-loss chain 215, auxiliary support device 22, third insertion hole 221, second insertion rod 222, oxygen nozzle 23, charging line 24, and protrusion 25.

DETAILED DESCRIPTION OF THE EMBODIMENTS

The present disclosure will be further described below with reference to drawings.

As shown in FIG. 1, a multi-purpose rescue rod for toxic gas poisoning or drowning and electric shock rescue includes: an upright column 1, a C-shaped hook 2, a base 3, a fixing sleeve 4, a storage battery 5, a limiting device 6 and a lighting device 7. The upright column 1, the C-shaped hook 2, and the base 3 are all made of insulating materials. The upright column 1 is arranged vertically. The fixing sleeve 4 is arranged in a center of the base 3. A lower end of the upright column 1 is inserted into the fixing sleeve 4. A lower end of the C-shaped hook 2 is fixed to an upper end of the upright column 1. The upright column 1 includes an outer cylinder 101 and an inner cylinder 102. The storage battery 5 is arranged in the outer cylinder 101. The storage battery 5 is positioned at a lower end of an inner cavity of the outer cylinder 101. The storage battery 5 is connected with a charging line 24. A lower end of the inner cylinder 102 is inserted into the outer cylinder 101 and is positioned above the storage battery 5. An inner diameter of the outer cylinder 101 matches an outer diameter of the inner cylinder 102. The limiting device 6 for limiting a relative position between the outer cylinder 101 and the inner cylinder 102 is arranged on the outer cylinder 101. The lighting device 7 is arranged at an upper end of the inner cylinder 102. Various existing lighting fixtures can be used as the lighting device 7. The lighting device 7 is connected with the storage battery 5 through a telescopic spring wire. The telescopic spring wire is positioned inside the inner cylinder 102. A charging interface used for charging the storage battery 5 is arranged on the storage battery 5. A usage process of the multi-purpose rescue rod for toxic gas poisoning or drowning and electric shock rescue is as follows. Once it is found that a person accidentally fell into a biogas digester, drowned, or got an electric shock, rescue workers can quickly pull out the upright column 1 from the sleeve of the base 3 and take the rescue rod to the side of the biogas digester, a waterfront, or the person who got an electric shock. Rescue workers extends the C-shaped hook 2 into the biogas digester or towards the person who fell into the water or got an electric shock and hook the person up; or the person who fell into the biogas digester, drowned, or got an electric shock may actively hook the C-shaped hook 2 onto a belt around the waist. Thus, rescue workers may hook or poke the person in distress who fell into the biogas digester, drowned or got an electric shock out of the dangerous area. Both the upright column 1 and the C-shaped hook 2 are made of insulating materials, so that the occurrence of electric shock of rescue workers is avoided, which is safe and reliable. Furthermore, the length of the upright column 1 can be freely adjusted according to a depth of the biogas digester and a distance between the person who drowned or got an electric shock and the safe area, thereby preventing search and rescue workers from entering the dangerous area and causing accidents. Moreover, the entire search and rescue process can be quickly carried out, which greatly shortens search and rescue time, and prevents the person in distress from inhaling excessive biogas or water for a long time or getting an electric shock for a long time to lead to a death caused by poisoning, drowning, or getting an electric shock. When the search and rescue is finished, just insert the upright column 1 back into the sleeve on the base 3. Moreover, the multi-purpose rescue rod may be used as a clothes hanger. Thus, the multi-purpose rescue rod may be used as a clothes hanger when not used for rescue. Once, rescue is needed, rescue workers do not need to look for rescue tools everywhere, they just remove the clothes from the multi-purpose rescue rod and take the rescue rod to the side of the biogas digester, the waterfront, or the person who got an electric shock, which saves a lot of time for rescue workers, and the person in distress can be rescued timely. In addition, a lighting device 7 is provided, which can adapt to night rescue and a condition with insufficient light. When rescue is performed at night or during the day with insufficient light, just turn on the lighting device 7, and search and rescue workers do not need to carry the lighting device 7, so that the rescue rod is convenient and efficient to use.

Figure 2:
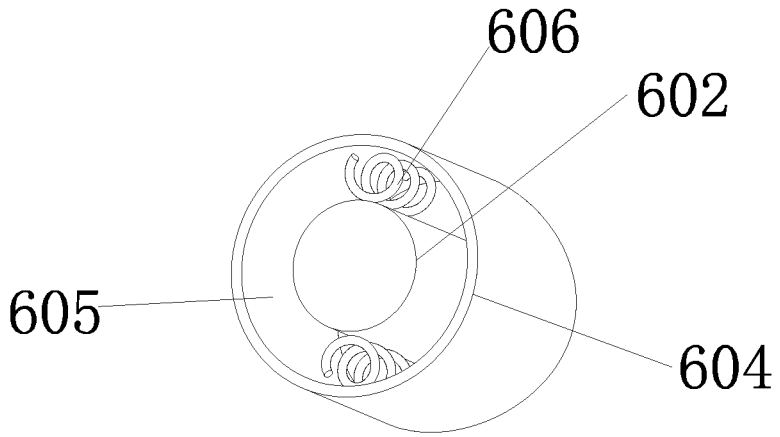
FIG. 2 is a schematic diagram of an internal structure of a limiting device according to the present disclosure.

In an above implementation, the limiting device 6 may be implemented by various existing bolt structures or threaded connection structures. In order to operate more conveniently and quickly, the following limiting device 6 is preferable in the present disclosure. Specifically, as shown in FIG. 2, the limiting device 6 includes a row of limiting holes 601 and a limiting rod 602. The row of limiting holes 601 formed in a side wall of the inner cylinder 102 in a length direction of the inner cylinder, and a through hole formed in an upper end of an outer side wall surface of the outer cylinder 101. A central axis of the through hole is perpendicular to a central axis of the outer cylinder 101. The limiting rod 602 is arranged in the through hole. A diameter of the through hole is equal to that of the limiting hole 601. When the through hole is corresponding to one of the limiting holes 601, an inner end of the limiting rod 602 extends into the limiting hole 601 through the through hole. When adjusting the length of the upright column 1, just pull out the inner cylinder 102 to a proper length, the through hole is enabled to be corresponding to one of the limiting holes 601, and then insert the limiting rod 602. In order to further facilitate operation, a circular stopper 603 is arranged at an upper end of the limiting rod 602; and a central axis of the circular stopper 603 coincides with a central axis of the limiting rod 602, and a diameter of the circular stopper 603 is greater than that of the limiting rod 602. Further, an annular plate 604 is arranged at the upper end of the outer side wall surface of the outer cylinder 101. A central axis of the annular plate 604 coincides with the central axis of the through hole. An inner diameter of the annular plate 604 is greater than the diameter of the through hole. An annular groove 605 is formed between an inner side surface of the annular plate 604 and an outer surface of the limiting rod 602. A plurality of springs 606 are arranged in the annular groove 605. An end of each spring 606 is fixed to a bottom of the annular groove 605, and another end of each spring 606 is fixed to an inner surface of the circular stopper 603. When the inner surface of the circular stopper 603 is in contact with an outer end face of the annular plate 604, each spring 606 is in a stretched state. Thus, when the inner cylinder 102 needs to be pulled out or inserted, just pull the circular stopper 603 outwards to detach the limiting rod 602 from the limiting hole 601. When the inner cylinder 102 is adjusted to a proper position, the through hole is enabled to be corresponding to one of the limiting holes 601, just release the circular stopper 603. Under the action of the spring 606, the circular stopper 603 moves inwards to drive the limiting rod 602 to be inserted into the limiting hole 601, so that a limiting action can be carried out automatically, and the operation is more convenient.

In order to enable rescue workers to know the concentration of biogas around the biogas digester timely and avoid rescue workers from chronic poisoning, moreover, in order to facilitate people to know the temperature, humidity, and time of the surrounding environment in time, a gas sensor 8, a temperature and humidity sensor 9, a display 10, an alarm 11, a timer 12, a distress caller 13, a distress calling switch control button 14, and a storage battery switch 15 are arranged on the outer side wall surface of the outer cylinder 101 in sequence from top to bottom. A controller is integrated in the display 10. The gas sensor 8, the temperature and humidity sensor 9, the display 10, the alarm 11, the timer 12, the distress caller 13, and the controller are electrically connected with the storage battery 5, respectively. The gas sensor 8, the temperature and humidity sensor 9, the display 10, the alarm 11, and the timer 12 are in communication with the controller through signals, respectively. The distress calling switch control button is arranged between the distress caller 13 and the storage battery 5. The storage battery switch 15 is connected to the storage battery 5. The gas sensor 8 includes a biogas concentration sensor and a carbon monoxide concentration sensor. The biogas concentration sensor detects the concentration of the biogas near the biogas digester, and rescue workers can know the concentration of the biogas around the biogas digester at any time. Once the concentration exceeds a limit, the alarm 11 will send out an alarm signal to remind rescue workers to carry out the rescue as soon as possible and stay away from the biogas digester to avoid secondary accidents. The carbon monoxide concentration sensor monitors the concentration of carbon monoxide at a place where the rescue rod is positioned. Once the concentration of the carbon monoxide exceeds a limit, the alarm 11 will send out an alarm signal to remind relevant personnel to stay away from this place. Various existing gas sensors 8 can be used as the biogas concentration gas and the carbon monoxide concentration sensor. The real-time data detected by the gas sensor 8 and the temperature and humidity sensor 9, as well as the time information of the timer 12 may be displayed through the display 10, so as to facilitate rescue workers to know the environment information of the rescue place at any time. In addition, the distress caller 13 is provided, which allows for more people to be called out for rescue, which improves the efficiency of rescue. When it is difficult to carry out rescue by a single person, the distress calling switch control button 14 may be turned on to call out people nearby to assist in carrying out rescue.

Moreover, a plurality of hanging rings 16 are fixedly arranged on an inner side surface of an upper end of the C-shaped hook 2 in a length direction of the C-shaped hook. A plurality of protrusions 25 are fixedly formed on an outer side surface of the upper end of the C-shaped hook 2 in the length direction of the C-shaped hook. A V-shaped groove is formed between two adjacent protrusions 25. When the rescue rod is not applicable to a rescue operation, the rescue rod may be used as a clothes hanger, which facilitates people to hang and pick up clothes.

In addition, the multi-purpose rescue rod for toxic gas poisoning or drowning and electric shock rescue further includes a portable oxygen cylinder 17, an oxygen pipe 18, a Velcro male buckle 19 and a Velcro female buckle 20. An outlet of the portable oxygen cylinder 17 is connected with the oxygen pipe 18. An oxygen nozzle 23 is arranged at an end of the oxygen pipe 18. The Velcro male buckle 19 is arranged on the oxygen pipe 18. A length of the oxygen pipe 18 between the Velcro male buckle 19 and the oxygen nozzle 23 is 30 to 50 cm. The Velcro female buckle 20 is arranged at an upper end of an outer side wall of the inner cylinder 102. When rescuing, the Velcro male buckle and Velcro female buckle are buckled together first. When the air in the biogas digester or rescue space is thin and oxygen is insufficient, the oxygen cylinder 17 may be connected to supply oxygen to the person in distress. Thus, when the C-shaped hook 2 is extended to the person in distress, the person in distress can insert the oxygen nozzle 23 into his mouth for oxygen inhalation. Especially in a case of biogas poisoning, the probability of death for persons in distress can be greatly reduced by providing oxygen.

Additionally, when it is difficult to carry out rescue by a single person, the distress calling switch control button may be turned on to call out people nearby to assist in carrying out rescue.

Finally, the lower end of the C-shaped hook 2 is fixed to the upper end of the upright column 1 through a rotatable structure 21. The rotatable structure 21 includes a first baffle 211 a second baffle 212, a first rotating shaft 213 and a first insertion rod 214. The first baffle 211 and the second baffle 212 fixedly arranged at a top end of the inner cylinder 102. The first baffle 211 and the second baffle 212 are arranged vertically and parallel to each other. The first rotating shaft 213 is arranged between the first baffle 211 and the second baffle 212. Both ends of the first rotating shaft 213 are fixed to an inner side surface of the first baffle 211 and an inner side surface of the second baffle 212, respectively. The lower end of the C-shaped hook 2 is sleeved on the first rotating shaft 213. A first insertion hole is formed in both the first baffle 211 and the second baffle 212. A second insertion hole is formed in the lower end of the C-shaped hook 2. A central axis of the first insertion hole formed in the first baffle 211 coincides with a central axis of the first insertion hole formed in the second baffle 212. A central axis of the second insertion hole is parallel to a central axis of the first rotating shaft 213. The first insertion rod 214 is arranged in the first insertion hole. A diameter of the first insertion hole, a diameter of the second insertion hole, and an outer diameter of the first insertion rod 214 are all equal in size. When the central axis of the first insertion hole coincides with the central axis of the second insertion hole, one end of the first insertion rod 214 passes through the first insertion hole formed in the first baffle 211, the second insertion hole in the lower end of the C-shaped hook 2, and the first insertion hole formed in the second baffle 212 in sequence. When encountering an irregular deep pit or deep well, after the C-shaped hook 2 is extended into the pit or well, the person in distress can pull out the first insertion rod 214 to rotate the C-shaped hook 2, so that the C-shaped hook is more easily hooked onto a belt or clothing of the person in distress. In order to prevent the first insertion rod 214 that has been pulled out from falling down, a rear end of the first insertion rod 214 is fixedly connected with an anti-loss chain 215; and another end of the anti-loss chain 215 is fixed to an upper end of an outer side wall of the inner cylinder 102.

The multi-purpose rescue rod for toxic gas poisoning or drowning and electric shock rescue is inserted into the sleeve on the base when rescue is not performed, so as to prevent the multi-purpose rescue rod from overturning mainly through the base. In order to further prevent the multi-purpose rescue rod from overturning, an auxiliary support device 22 is arranged on the base 3. The auxiliary support device 22 includes a plurality of third insertion holes 221 formed in a side surface of the base 3. The plurality of third insertion holes 221 are uniformly distributed around the center of the base 3. Second insertion rods 222 are arranged in the third insertion holes 221. The second insertion rods 222 are perpendicular to the upright column 1 and extension lines of central axes of the second insertion rods 222 pass through the center of the base 3. During use, just pull out the second insertion rods 222 from the third insertion holes 221 for a certain distance. The longer the length of the second insertion rods 222 pulled out, the better the support effect, and the less likely the multi-purpose rescue rod is to overturn. However, the second insertion rods 222 cannot be completely pulled out from the third insertion holes 221. In addition, the second insertion rods 222 are telescopic rods. During use, the second insertion rods 222 may be extended to ensure the support effect and prevent the multi-purpose rescue rod from overturning.

What is claimed is:

1. A multi-purpose rescue rod for toxic gas poisoning or drowning and electric shock rescue, comprising: an upright column, a C-shaped hook, a base, a fixing sleeve, a storage battery, a limiting device, and a lighting device; the upright column, the C-shaped hook, and the base are all made of insulating materials; the upright column is arranged vertically; the fixing sleeve is arranged in a center of the base; a lower end of the upright column is inserted into the fixing sleeve; a lower end of the C-shaped hook is fixed to an upper end of the upright column; the upright column comprises an outer cylinder and an inner cylinder; the storage battery is arranged in the outer cylinder; the storage battery is positioned at a lower end of an inner cavity of the outer cylinder; the storage battery is connected with a charging line; a lower end of the inner cylinder is inserted into the outer cylinder and is positioned above the storage battery; an inner diameter of the outer cylinder matches an outer diameter of the inner cylinder; the limiting device for limiting a relative position between the outer cylinder and the inner cylinder is arranged on the outer cylinder; the lighting device is arranged at an upper end of the inner cylinder; the lighting device is connected with the storage battery through a telescopic spring wire; and the telescopic spring wire is positioned inside the inner cylinder, wherein the limiting device comprises:

a row of limiting holes formed in a side wall of the inner cylinder in a length direction of the inner cylinder, and a through hole formed in an upper end of an outer side wall surface of the outer cylinder, a central axis of the through hole is perpendicular to a central axis of the outer cylinder;

a limiting rod arranged in the through hole; and a diameter of the through hole is equal to that of the limiting hole, and when the through hole is corresponding to one of the limiting holes, an inner end of the limiting rod extends into the limiting hole through the through hole.

2. The multi-purpose rescue rod for toxic gas poisoning or drowning and electric shock rescue according to claim 1, wherein a circular stopper is arranged at an upper end of the limiting rod, a central axis of the circular stopper coincides with a central axis of the limiting rod, and a diameter of the circular stopper is greater than that of the limiting rod.

3. The multi-purpose rescue rod for toxic gas poisoning or drowning and electric shock rescue according to claim 2, wherein an annular plate is arranged at the upper end of the outer side wall surface of the outer cylinder, a central axis of the annular plate coincides with the central axis of the through hole, an inner diameter of the annular plate is greater than the diameter of the through hole; an annular groove is formed between an inner side surface of the annular plate and an outer surface of the limiting rod; a plurality of springs are arranged in the annular groove; an end of each spring is fixed to a bottom of the annular groove, and another end of each spring is fixed to an inner surface of the circular stopper; and when the inner surface of the circular stopper is in contact with an outer end face of the annular plate, each spring is in a stretched state.

4. The multi-purpose rescue rod for toxic gas poisoning or drowning and electric shock rescue according to claim 3, wherein a gas sensor, a temperature and humidity sensor, a display, an alarm, a timer, a distress caller, a distress calling switch control button, and a storage battery switch are arranged on the outer side wall surface of the outer cylinder in sequence from top to bottom; a controller is integrated in the display; the gas sensor, the temperature and humidity sensor, the display, the alarm, the timer, the distress caller, and the controller are electrically connected with the storage battery, respectively; the gas sensor, the temperature and humidity sensor, the display, the alarm, and the timer are in communication with the controller through signals, respectively; the distress calling switch control button is arranged between the distress caller and the storage battery; and the storage battery switch is connected to the storage battery.

5. The multi-purpose rescue rod for toxic gas poisoning or drowning and electric shock rescue according to claim 4, wherein a plurality of hanging rings are fixedly arranged on an inner side surface of an upper end of the C-shaped hook in a length direction of the C-shaped hook; a plurality of protrusions are fixedly arranged on an outer side surface of the upper end of the C-shaped hook in the length direction of the C-shaped hook; and a V-shaped groove is formed between two adjacent protrusions.

6. The multi-purpose rescue rod for toxic gas poisoning or drowning and electric shock rescue according to claim 5, further comprising a portable oxygen cylinder, wherein an outlet of the portable oxygen cylinder is connected with an oxygen pipe; an oxygen nozzle arranged at an end of the oxygen pipe; a hook-and-loop fastener male buckle arranged on the oxygen pipe, a length of the oxygen pipe between the hook-and-loop fastener male buckle and the oxygen nozzle is 30 cm to 50 cm; and a hook-and-loop fastener female buckle arranged at an upper end of an outer side wall of the inner cylinder.

7. The multi-purpose rescue rod for toxic gas poisoning or drowning and electric shock rescue according to claim 6, wherein the lower end of the C-shaped hook is fixed to the upper end of the upright column through a rotatable structure; the rotatable structure comprises: a first baffle; a second baffle fixedly arranged at a top end of the inner cylinder, the first baffle and the second baffle are arranged vertically and are parallel to each other; a first rotating shaft arranged between the first baffle and the second baffle, both ends of the first rotating shaft are fixed to an inner side surface of the first baffle and an inner side surface of the second baffle, respectively, the lower end of the C-shaped hook is sleeved on the first rotating shaft, a first insertion hole is formed in both of the first baffle and the second baffle, a second insertion hole is formed in the lower end of the C-shaped hook, a central axis of the first insertion hole formed in the first baffle coincides with a central axis of the first insertion hole formed in the second baffle, a central axis of the second insertion hole is parallel to a central axis of the first rotating shaft; and a first insertion rod arranged in the first insertion hole, a diameter of the first insertion hole, a diameter of the second insertion hole, and an outer diameter of the first insertion rod are all equal in size, when the central axis of the first insertion hole coincides with the central axis of the second insertion hole, a front end of the first insertion rod passes through the first insertion hole formed in the first baffle, the second insertion hole in the lower end of the C-shaped hook, and the first insertion hole formed in the second baffle in sequence.

8. The multi-purpose rescue rod for toxic gas poisoning or drowning and electric shock rescue according to claim 7, wherein a rear end of the first insertion rod is fixedly connected with an anti-loss chain; and another end of the anti-loss chain is fixed to an upper end of an outer side wall of the inner cylinder.

9. The multi-purpose rescue rod for toxic gas poisoning or drowning and electric shock rescue according to claim 8, wherein an auxiliary support device is arranged on the base; the auxiliary support device comprises: a plurality of third insertion holes formed in a side surface of the base, the plurality of third insertion holes are uniformly distributed around the center of the base; second insertion rods arranged in the third insertion holes, and the second insertion rods are perpendicular to the upright column and extension lines of central axes of the second insertion rods pass through the center of the base.

* * * * *